US012121127B2

(12) United States Patent
Seminara

(10) Patent No.: US 12,121,127 B2
(45) Date of Patent: Oct. 22, 2024

(54) LUGGAGE ARTICLE INCLUDING AN EASY ACCESS SYSTEM

(71) Applicant: Samsonite IP Holdings S.a r.l., Luxembourg (LU)

(72) Inventor: Michele Seminara, Gorla Minore (IT)

(73) Assignee: Samsonite IP Holdings S.a r.l., Luxembourg (LU)

( * ) Notice: Subject to any disclaimer, the term of this patent is extended or adjusted under 35 U.S.C. 154(b) by 269 days.

(21) Appl. No.: 16/548,936

(22) Filed: Aug. 23, 2019

(65) Prior Publication Data

US 2020/0060399 A1 Feb. 27, 2020

(30) Foreign Application Priority Data

Aug. 24, 2018 (EP) ..... 18190843

(51) Int. Cl.

| | |
|---|---|
| ***A45C 5/06*** | (2006.01) |
| ***A45C 5/03*** | (2006.01) |
| ***A45C 5/14*** | (2006.01) |

(52) U.S. Cl.

CPC ..... *A45C 5/06* (2013.01); *A45C 5/03* (2013.01); *A45C 5/14* (2013.01)

(58) Field of Classification Search

CPC ..... A45C 5/06; A45C 5/03; A45C 5/14

See application file for complete search history.

(56) References Cited

U.S. PATENT DOCUMENTS

| | | | | |
|---|---|---|---|---|
| 4,817,802 | A | 4/1989 | Pratt | |
| 5,431,263 | A * | 7/1995 | Nordstrom | A45C 13/262 190/18 A |
| 5,526,907 | A | 6/1996 | Trawick et al. | |
| 5,660,476 | A * | 8/1997 | DeCoster | A45C 13/02 383/110 |
| 5,725,090 | A | 3/1998 | Vermillion et al. | |
| 5,810,166 | A * | 9/1998 | Weinreb | A45C 13/103 224/236 |
| 6,000,509 | A | 12/1999 | Chisholm | |
| 6,230,952 | B1 * | 5/2001 | Jupiter | A45F 3/04 224/655 |
| 6,237,776 | B1 | 5/2001 | Mogil | |

(Continued)

FOREIGN PATENT DOCUMENTS

| | | | |
|---|---|---|---|
| CN | 203801902 U * | 9/2014 | A45C 13/103 |
| DE | 202013100661 U1 | 5/2018 | |

(Continued)

OTHER PUBLICATIONS

"Discovery Daypack, Tenba", http://www.shutterbug.com/content/photo-backpacks-and-sling-bags-camera-carrierssightseeing-and-adventure-travel, Jul. 27, 2018, 1 page.

(Continued)

*Primary Examiner* — Tri M Mai

(74) *Attorney, Agent, or Firm* — Dorsey & Whitney LLP

(57) ABSTRACT

A luggage article including an easy access system is provided. The easy access system may include two or more doors positioned on a top portion of the luggage article. The doors may open in opposite directions to one another, for (Continued)

example, towards one another. The doors may provide access to two separate compartments, for example, to a main compartment and a secondary compartment.

13 Claims, 14 Drawing Sheets

(56) References Cited

U.S. PATENT DOCUMENTS

| | | | | |
|---|---|---|---|---|
| 6,334,519 | B1 * | 1/2002 | Tong | A45C 7/0086 190/110 |
| 6,516,927 | B2 * | 2/2003 | Krulik | A45C 3/02 150/114 |
| 7,374,071 | B2 | 5/2008 | Lavelle | |
| D597,309 | S | 8/2009 | Hong | |
| 7,588,146 | B1 | 9/2009 | Salander et al. | |
| 7,886,884 | B2 | 2/2011 | King et al. | |
| 7,900,758 | B2 | 3/2011 | King et al. | |
| D637,811 | S | 5/2011 | Hong | |
| 9,215,918 | B2 * | 12/2015 | Kao | A45C 13/03 |
| 9,392,855 | B2 | 7/2016 | Taylor | |
| 9,894,970 | B2 * | 2/2018 | Sheikh | A45C 13/00 |
| 2002/0148694 | A1 * | 10/2002 | Tong | A45C 3/004 190/110 |
| 2003/0029755 | A1 | 2/2003 | Ho | |
| 2004/0154889 | A1 | 8/2004 | Gifford et al. | |
| 2008/0099355 | A1 * | 5/2008 | Bakker | A45C 5/06 206/349 |
| 2009/0229936 | A1 | 9/2009 | Cuong et al. | |
| 2009/0294455 | A1 * | 12/2009 | Pruchnicki | B65D 81/3816 220/592.2 |
| 2011/0198374 | A1 | 8/2011 | Majeau | |
| 2013/0175130 | A1 | 7/2013 | Liang | |
| 2013/0284553 | A1 | 10/2013 | Daniels et al. | |
| 2014/0027224 | A1 * | 1/2014 | Lai | A45C 5/03 190/111 |
| 2016/0213132 | A1 * | 7/2016 | Ford | A45F 3/02 |
| 2018/0125186 | A1 | 5/2018 | Fernandez | |
| 2018/0263345 | A1 * | 9/2018 | Meersschaert | A45C 5/03 |
| 2019/0298026 | A1 * | 10/2019 | Lai | A45C 7/0027 |

FOREIGN PATENT DOCUMENTS

| | | | |
|---|---|---|---|
| GB | 2489217 | A | 9/2012 |
| WO | 2014097225 | A1 | 6/2014 |
| WO | 2017068172 | A2 | 4/2017 |

OTHER PUBLICATIONS

"Drifter Laptop Bag (Annex Collection), STM", http://syndicate.details.com/post/stms-annex-collection-stylish-and-durable-everyday-bags, Jul. 27, 2018, 1 page.

"Multi-Access 360 degree Carry-On Luggage", https://www.sharperimage.com/si/view/product/Multi-Access+360+degree+Carry-On+Luggage/, Jul. 27, 2018.

"No Matter What Flatbed 20, Eagle Creek", http://shop.eaglecreek.com/nomatter-what-flatbed-20/d/1410, Jul. 27, 2018, 1 page.

"Pro VII Backpack, Manfrotto", http://www.shutterbug.com/content/photo-backpacks-and-sling-bags-camera-carrierssightseeing-and-adventure-travel, Jul. 27, 2018, 1 page.

"ProTactic 350 AW Camera Backpack, Lowepro", http://www.photoreview.com.au/reviews/accessories/lowepro-protactic-350-aw-camerabackpack, Jul. 27, 2018, 1 page.

"Sling-O-Matic 30, Think Tank Photo", http://www.shutterbug.com/content/photo-backpacks-and-sling-bags-camera-carrierssightseeing-and-adventure-travel, Jul. 27, 2018, 1 page.

"Smart Luggage, Bluesmart", https://www.amazon.com/Bluesmart-One-International-Carry-TSAApproved/dp/B00X5OUC1U, Jul. 27, 18, 1 page.

* cited by examiner

LUGGAGE ARTICLE INCLUDING AN EASY ACCESS SYSTEM

CROSS-REFERENCE TO RELATED APPLICATION

This application claims priority to European Patent Application No. 18190843.5, filed Aug. 24, 2018, entitled "Luggage Article Including an Easy Access System", which is hereby incorporated by reference herein in its entirety for all purposes.

TECHNICAL FIELD

The present disclosure relates generally to luggage articles, and more specifically to a luggage article including an easy access system.

BACKGROUND

Many traditional luggage cases include a main door that provides centralized access to a main compartment. Some luggage cases may also include pockets on the main door that provide access to smaller secondary compartments. Such pockets may be too small or narrow to hold items such as a laptop computer or a tablet. In this case, the laptop computer or tablet may need to be stored in the main compartment. When such a luggage case is stored as a carry-on item in either an overhead compartment or under a seat, the main compartment and/or pockets may be difficult to access. For example, to access a laptop in the main compartment, the entire luggage case may need to be removed from the overhead bin or pulled out from under the seat to open the main door. As another example, when the luggage case is under the seat, the pockets on the main door may be difficult to access, also requiring pulling the entire luggage case out from under the seat.

It is therefore desirable to provide an improved luggage case, and more specifically, an improved access structure that addresses one or all of the above described problems and/or which more generally offers improvements or an alternative to existing arrangements.

Documents that may be related to the present disclosure include US20040154889, U.S. Pat. Nos. 7,900,758, 7,886,884, US20130284553 A1, US20130175130 A1, U.S. Pat. No. 9,392,855 B2, 637,811 S, U.S. Pat. No. 7,588,146 B1, 597,309 S, U.S. Pat. Nos. 7,374,071 B2, 6,000,509 A, 5,526,907 A, 6,237,776 B1, and WO 2017/068172 A2.

SUMMARY

The present disclosure provides an easy access system for a luggage article, as described below and defined in the accompanying claims. The easy access system may include two or more doors positioned on a top portion of the luggage article that provide convenient access to one or more compartments when the luggage article is stowed in an overhead compartment or under a structure (e.g., a seat). The doors may open in directions opposite one another, such as, for example, towards one another. The doors may share a common hinge. The common hinge may be coupled to a top panel of the luggage article. At least one of the one or more compartments may be removable.

Embodiments of the present disclosure may include a luggage article. The luggage article may include a first panel adjacent to a second panel. A first door may be defined by at least a portion of the first panel and at least a portion of the second panel. The first door may be selectively coupled to at least another portion of the second panel. The position of the first door may allow access through either or both of the portion of first panel and the portion of the second panel to contents within the luggage article. A second door may be hingedly connected to the first door. The second door may allow separate access from the first door to the luggage article contents. The first door and the second door may open towards each other. The different manner in which the first and second doors open may allow easier access to contents within the luggage article when the luggage article is in various orientations (e.g., in the upright position, horizontally stored above a user, horizontally stored below a user, and the like). Additionally or separately, the first door and the second door may provide access to a main compartment.

Additionally or separately, the first panel may be a front panel. Additionally or separately, the second panel may be a top panel. Additionally or separately, the second door may be defined within at least a portion of the first panel and at least a portion of the second panel. The position of the second door may allow access through either or both of the portion of first panel and the portion of the second panel to contents within the luggage article.

Additionally or separately, the first door may open in a direction away from the second panel. The direction the first door opens may allow easier access to contents within the luggage article when the luggage article is in particular orientations (e.g., when the luggage article is in an upright position and/or stored horizontally in an overhead compartment). Additionally or separately, the second door may open in a direction towards the second panel. The direction the second door opens may allow easier access to contents within the luggage article when the luggage article is in various orientations (e.g., when the luggage article is in an upright position and/or stored horizontally under a seat). Additionally or separately, the portion of the first door defined within the second panel may be movable relative to a remaining portion of the first door defined within the first panel. This may allow the first door to be partially opened, for example, allowing access through only the second panel.

Additionally or separately, the luggage article may include a secondary compartment. The secondary compartment may allow for storage of articles separate from the main compartment. The secondary compartment may be detachable from the luggage article. Where the secondary compartment is detachable, it may be selectively included or omitted in the luggage article, depending upon user preference. Additionally or separately, the secondary compartment may be connected to the luggage article by at least one of snap buttons and Velcro. Such fastening mechanisms may allow for easy and quick insertion and/or removal of the secondary compartment with the luggage article. Additionally or separately, the second door may provide access to the secondary compartment. This may allow for easy access of the secondary compartment through the second door without needing to open the first door.

Additionally or separately, the first and second doors may be opened by one or more zippers. Additionally or separately, the second door may be defined by a portion of the first door. This may allow access to the luggage article contents through a door that is smaller and more convenient than the first door. Additionally or separately, the luggage article may include a tow handle. The first door may open away from the tow handle and the second door may open towards the tow handle. This may allow easy access to the luggage article contents through either the first door or the second door depending upon the orientation and positioning of the tow handle. Additionally or separately, the first door may be coupled to a corner region of the luggage article by a selectively operable gusset. The selectively operable gusset may control the distance the first door may be moved relative to the luggage article.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

DETAILED DESCRIPTION

Figure 1:
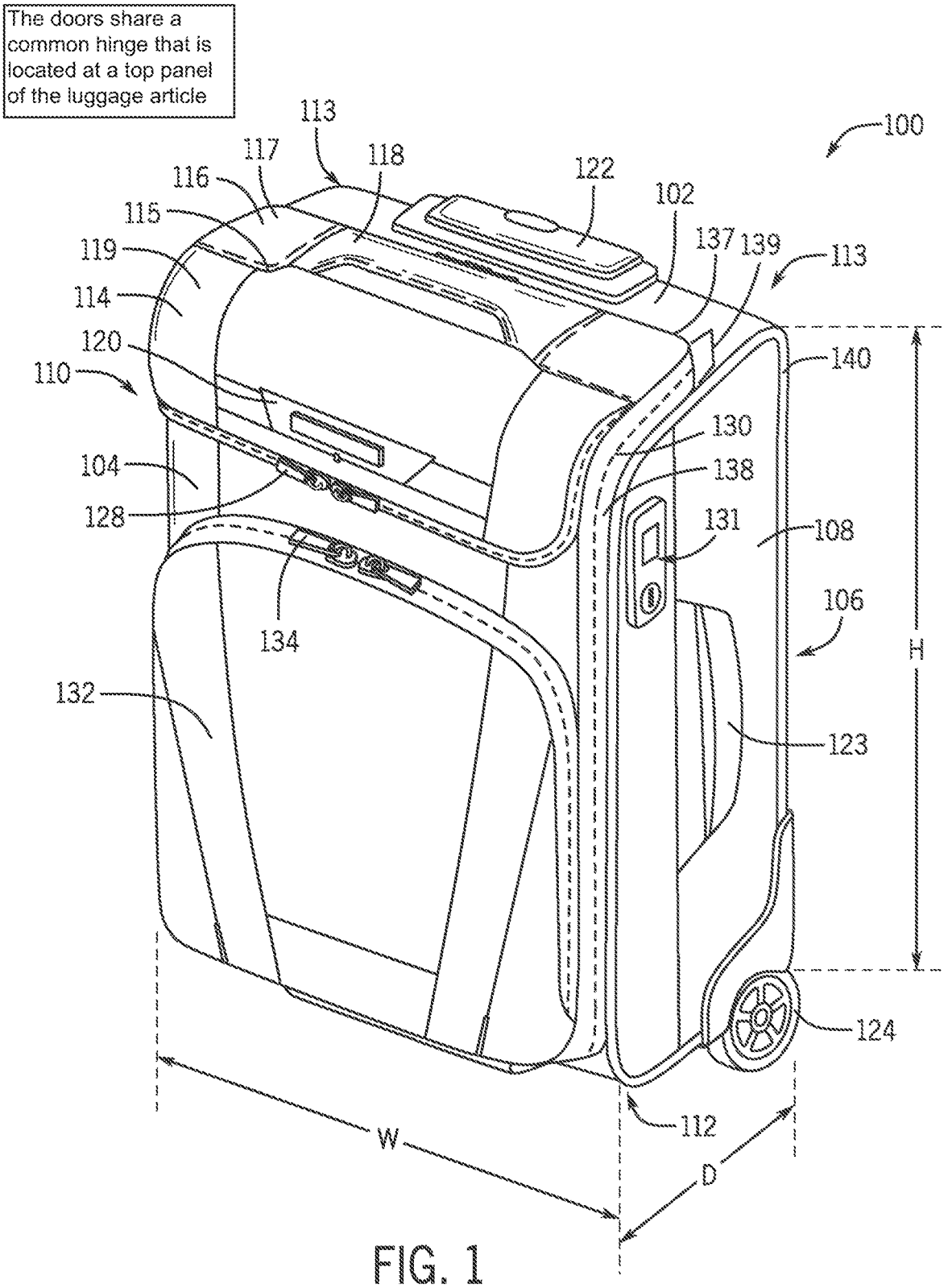
FIG. 1 is a front isometric view of a luggage article according to some examples of the present disclosure.

According to the present disclosure, an easy access system for a luggage article is disclosed for providing convenient access to one or more compartments when the luggage article is stowed in an overhead compartment or under a structure (e.g., a seat). The easy access system may include two or more doors positioned on a top portion of the luggage article. The doors may open in opposite directions relative to one another, such as, for example, towards one another. Optionally, the doors may share a common hinge that is located at a top panel of the luggage article. The doors may provide access to two separate compartments, such as, for example, a main compartment and a secondary compartment.

In several embodiments, a luggage article is disclosed that has at least two access points to a main compartment and/or a secondary compartment. A first door may cover a primary opening, providing a first access point. The first door may cover at least a portion of a front panel and extend over at least a portion of a top panel of the luggage case. A secondary opening may be defined within a portion of the first door. The secondary opening may be covered by a second door, providing a second access point. The second door may be positioned on an upper portion of the first door, such that the second door also extends over both the front panel and the top panel of the luggage article. In this manner, the second door may extend over a corner region of the luggage article defined by the intersection of the front panel and the top panel, providing corner access to articles stored therein. Either or both of the first door and the second door may be opened to access one or both of the main compartment and the secondary compartment. As one example, the first door may be fully opened, exposing the entire primary opening, to allow centralized access to the main compartment and/or secondary compartment. As another example, the first door may be partially opened, exposing only the portion of the primary opening defined within the top panel of the luggage case, to allow top access to the main compartment and/or secondary compartment. As yet another example, the second door may be fully opened, exposing the entire secondary opening, to allow corner access to the main compartment and/or secondary compartment. As an additional example, the second door may be partially opened, exposing only the portion of the secondary opening defined within the front panel of the luggage article, to allow front access to the main compartment and/or secondary compartment. The first and second doors may open in directions opposite one another. As one example, the first door may open in a direction away from the top panel, while the second door may open in a direction towards the top panel. As another example, the first and second doors may open towards one another.

FIGS. 1-6 illustrate an exemplary luggage article or case 100 according to some examples of the present disclosure. The luggage article 100 may be formed from a plurality of walls or panels (hereinafter "panels" for the sake of convenience without intent to limit) defining a main internal storage volume or compartment 148 in which to carry a user's belongings. In one example, the luggage article 100 may be formed from opposing front and rear panels 104, 106 and a plurality of side panels extending between the front and rear panels 104, 106. For instance, the luggage article 100 may include opposing top and bottom panels 102, 112 and opposing left and right side panels 108, 110 extending between the front and rear panels 104, 106. Corner regions 113 may be defined by the intersection of any two or three adjacent panels. For example, corners formed by the intersection of any three adjacent panels may be considered a "corner region." Edges formed by the intersection of any two adjacent panels may also be considered a "corner region." As shown in FIGS. 1, 4A-5, and 7A-E, the corner regions 113 may have a sloped or curved shape defining a gradual transition between different panels, such that one portion of the corner region 113 may be one panel, while another portion may be another panel.

The various panels may be configured or arranged to provide a desired size and shape of the luggage article 100. As shown in FIG. 1, the various panels may be sized and shaped to provide a height H, width W, and depth D of the luggage article 100. The height H of the luggage article 100 may be defined as the distance between the top and bottom panels 102, 112. The width W of the luggage article 100 may be defined as the distance between the left and right side panels 108, 110. Similarly, the depth D of the article 100 may be defined as the distance between the front and rear panels 104, 106. The panels may be sized and shaped such that the luggage article 100 is taller than it is wide and wider than it is deep, such as that shown in at least FIG. 1. Other sizes and shapes of the luggage article 100 are contemplated, and the examples shown and described are for illustration purposes only.

The luggage article 100 illustrated in FIGS. 1-6 is a soft side luggage article but may be many types of luggage articles, including a hard side luggage article, a container, a backpack, a duffle bag, a purse, or the like. The luggage article 100 may include a tow handle 122, a carry handle 123, and/or one or more support members 124, 126. The tow handle 122 may be retractable, allowing a user to pull the tow handle 122 upwards to an extended position or push the tow handle 122 downwards to a stowed position. The tow handle 122 may be coupled to the rear panel 106 of the luggage case 100 by a sleeve 136 positioned on the rear panel 106. The sleeve 136 may partially enclose the tow handle 122. The carry handle 123 may be positioned on a side panel of the luggage case 100. As shown in FIG. 1, the carry handle 123 is positioned on the left side panel 108; however, it is contemplated that the carry handle 123 may be positioned on other side panels and that there may be more than one carry handle 123 on the luggage case 100 to facilitate in carrying the luggage case 100. As shown in FIG. 7D, the carry handle 123 may be integrated with the tow handle 122. For example, the carry handle 123 may be coupled to a recessed region housing the tow handle 122 and may be moved, such as by pivoting, between a retracted position and an operative position.

The one or more support members 124, 126 may support the luggage article 100 against a support surface (e.g., against the ground). The support members 124, 126 may be a foot, a fixed wheel assembly, a spinner wheel assembly, or any combination thereof. As shown, the luggage article 100 may include three support members 124, 126. In such examples, the luggage article 100 may include two wheels 124 and a support structure 126. The support structure 126 may be a post and rod combination of a similar height as the wheels 124 to provide even support to the luggage case 100 when the luggage case 100 is in a resting upright position. Alternatively, the support structure 126 may comprise two separate feet spaced apart. For example, the two feet may be positioned on laterally opposing corner regions 113. In this example, the luggage article 100 includes four support members 124, 126. The support structure 126 may be made of any material capable of friction contact with the ground or floor, such as, for example, rubber.

The support members 124, 126 may be connected to any suitable portion of the luggage article 100, such as, for example, connected to at least the bottom panel 112 or at or near the corner regions 113 along the bottom panel 112. For instance, the wheels 124 may be connected at or near the corner regions 113 defined by the intersection of the rear panel 106, the left or right side panels 108, 110, and the bottom panel 112. The support structure 126 may be connected to a front portion of the bottom panel 112 near the front panel 104. It is contemplated that the support structure 126 may be omitted and instead replaced by additional wheels. For example, the luggage case 100 may include four wheels or spinner assemblies. In this example, the two additional wheels or spinner assemblies may be connected at or near the corner regions 113 defined by the intersection of the front panel 104, the left or right side panels 108, 110, and the bottom panel 112.

Figure 8:
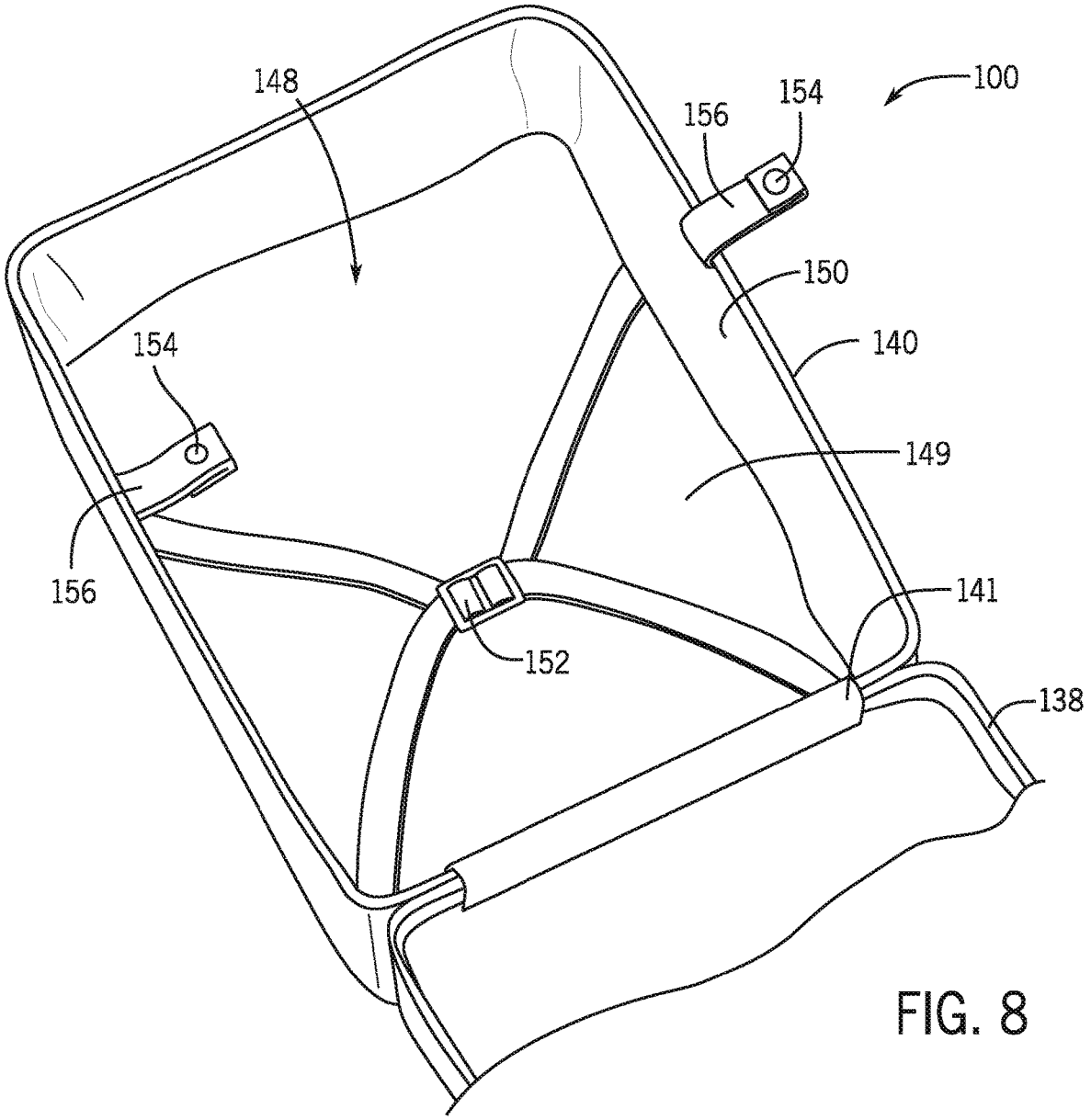
FIG. 8 is a view of the luggage article in an open configuration.

As shown, the luggage article 100 includes a plurality of doors to provide access to one or more compartments of the luggage article 100. The plurality of doors may include a main door 138, a top access door 116, and a front access door 114. The main door 138 and top access door 116 may both provide access to a main internal storage compartment 148 (shown in FIG. 8), while the front access door 114 may provide access to a secondary storage compartment 158 (shown in FIG. 9), to the main storage compartment 148, or to both. The top access door 116 is part of the main door 138 and corresponds to an upper portion of the main door 138 that may be only partially opened to allow access to the main compartment 148. The main door 138 may seal an opening to the main internal storage compartment 148 when in a closed position. The main door 138 may be secured to the luggage article 100 by a main access opening mechanism 130, such as, for example, a zipper. When in the closed position, the main door 138 may cover the entirety of or substantially all of the front panel 104 and may also cover a portion of the top panel 102. The main door 138 may have a thickness or lip 139. In one example, the main door 138 is a solid door with a thickness 139 that is sufficient to maintain the structure of the front panel 104 while still providing flexibility for the main door 138 to bend, e.g. so the top access door 116 can be partially opened. In another example, the main door 138 has a concave interior surface (not shown), providing a lip 139 that extends towards and couples to the luggage article 100 when the main door 138 is in the closed position. In this example, the main door 138 may still have the flexibility to bend. In yet another example, the main door 138 may be flush with the luggage article 100. As shown in FIG. 8, the main door 138 may have a hinge 141 on one side that is coupled to the luggage article 100. For example, in the depicted embodiment, the hinge 141 extends along the bottom panel 112. As another example, the hinge 141 may extend along a corner region 113, such as, for example, the corner region 113 created by the intersection of the front panel 104 and the bottom panel 112.

Figure 4A:
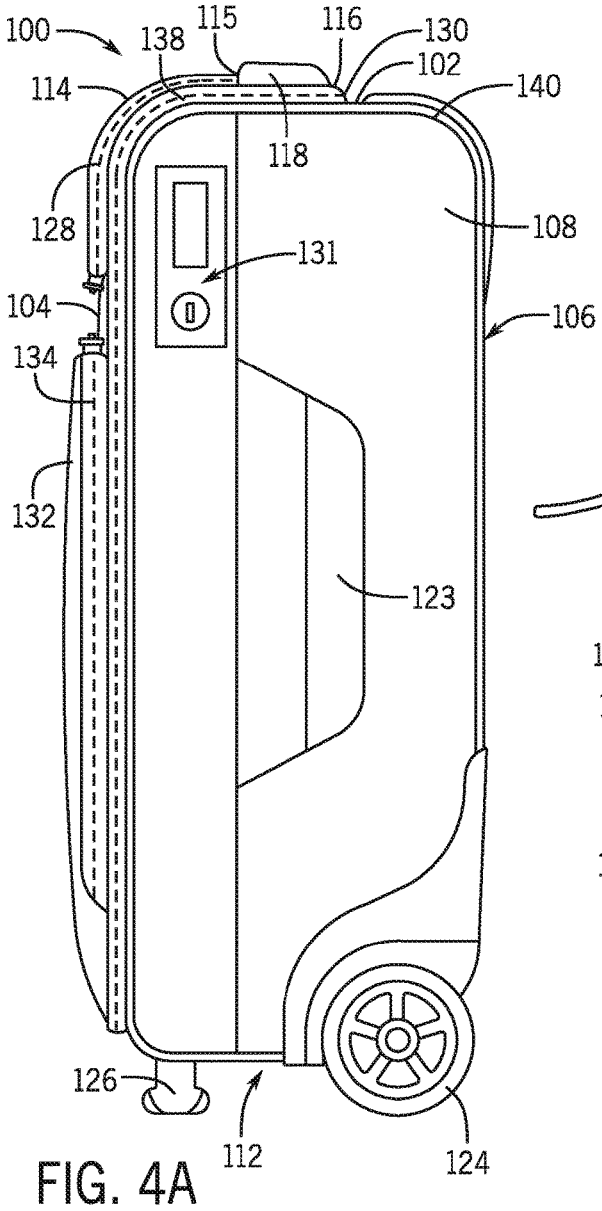
FIG. 4A is a left side view of the luggage article of FIG. 1.
Figure 4B:
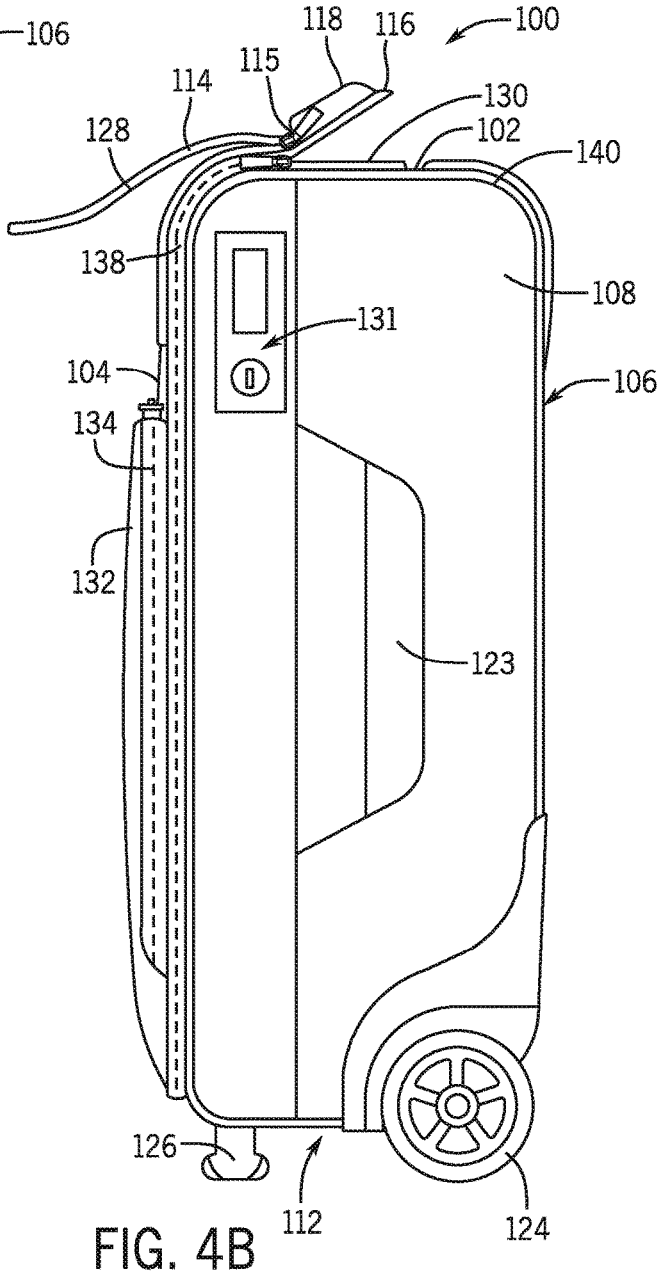
FIG. 4B is a left side view of the luggage article of FIG. 1 with the front and top access doors in an open position.
Figure 4C:
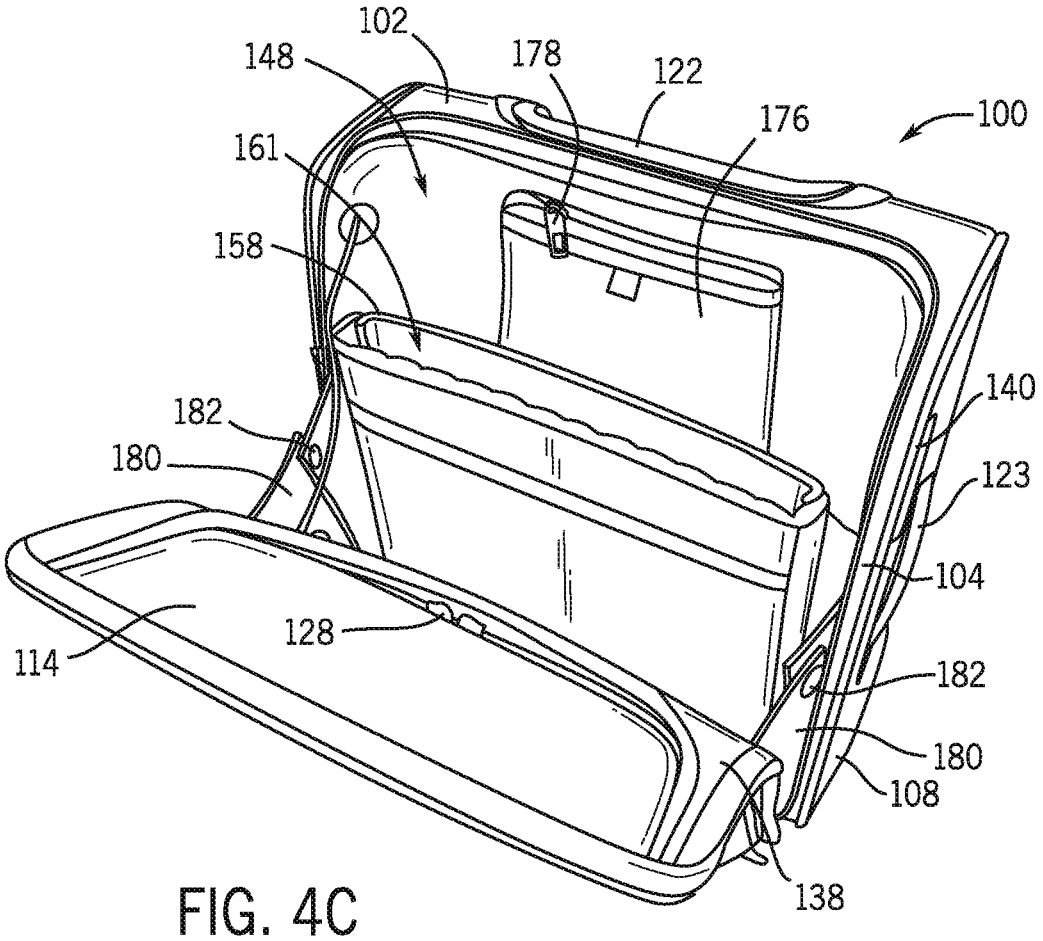
FIG. 4C is a front isometric view of the luggage article of FIG. 1 with the main door in an open position.

As shown in FIG. 4C, the main door 138 may also include a gusset 180 to maintain the positioning of the main door 138. The gusset 180 may be a piece of material or fabric positioned on a lower portion of the luggage article 100 between an edge portion of the main door 138 and a corner region 113 of the luggage article 100, such as the corner region 113 formed by the intersection of the front panel 104 and the side panel 108 or 110. As shown, the main door 138 includes two gussets 180 on opposing edge portions. Each gusset 180 may include a fastening mechanism 182, such as a snap fastener, that, when fastened, maintains the structure and function of the gusset 180. When the fastening mechanism 182 is unfastened, the gusset 180 becomes disengaged or opened. The gusset 180 may be selectively operable depending upon whether the fastening mechanism 182 is fastened or unfastened. When the fastening mechanism 182 is fastened, the gusset 180 is operable, preventing the main door 138 from opening entirely. For example, when the luggage article 100 is in an upright position, the gusset 180 may maintain the position of the main door 138 at an angle of less than 90 degrees from the luggage article 100. As one example, the main door 138 may not extend beyond 45 degrees from the luggage article 100 due to the gusset 180. However, the fastening mechanism 182 may be unfastened to disengage the gusset 180, such that the gusset 180 is inoperable, and the main door 138 may extend beyond 90 degrees. When the gusset 180 is disengaged, the main door 138 may open entirely (e.g., to a 180 degree angle from the luggage article 100 or greater).

With reference to FIGS. 1 and 4-7B, the top access door 116 is defined by a top portion of the main door 138. More specifically, the top access door 116 may be a portion of the main door 138 between the top edge 137 of the main door 138 and, optionally, a hinge line 115, or it may extend past the hinge line 115 such that the top access door 116 is simply the main door 138 in a partially opened configuration. The top access door 116 may cover an opening defined entirely within the top panel 102. The top access door 116 and main door 138 open in a direction away from the top panel 102, the back panel 106, and the tow handle 122, and towards the front panel 104 and the bottom panel 112, as shown in FIGS. 4B-C and 7A-C. The top access door 116 may include a top access handle 118 on an outer surface 117. The top access handle 118 may be a raised extension of the outer surface 117 and may form a cavity thereunder for a user's fingers or hand to grasp around the top access handle 118. As shown in FIG. 7C, in an alternate embodiment, the top access handle 118 may be omitted. In this embodiment, a user may open or close the top access door 116 by engaging and/or disengaging the main access opening mechanism 130.

When in the closed position, the top access door 116 may be secured to and selectively coupled to the luggage article 100 by the main access opening mechanism 130. The main access opening mechanism 130 may be positioned along one or more edges of the top access door 116 to engage the top access door 116 and allow selective engagement for opening and closing of the top access door 116. The main access opening mechanism 130 may be a discrete mechanism, such as a latch, or may be a continuous-closure mechanism positioned along at least a part of the length of an edge of the top access door 116, such as a zipper. In an open configuration, the main access opening mechanism 130 may be disengaged along a length of the edge of the top access door 116 (e.g., to the hinge line 115) sufficient to allow the top access door 116, and the main door 138, to pivot relative to the bottom panel 112 from partially open to fully open. In a closed configuration, the main access opening mechanism 130 is engaged along at least a portion of the length of an edge of the top access door 116 to limit relative movement between the top access door 116 and the bottom panel 112.

The main access opening mechanism 130 may be any suitable closure device or system. For instance, the main access opening mechanism 130 may be a zip closure or attachment. In such examples, zipper tape may be connected to the perimeter rim of the top access door 116. In some examples, the zipper tape may be connected to and extend along the lip 139 of the main door 138. In one example, the main access opening mechanism 130 may extend along at least three peripheral edges of the top access door 116, and optionally, the hinge 115 being positioned on a remaining edge of the top access door 116. Additionally, the main access opening mechanism 130 may extend along a portion of the length of the edge on the remaining edge of the top access door 116, with the hinge 115 extending along the balance of the length of the edge on the remaining edge. In another example, the main access opening mechanism 130 may be positioned along at least the peripheral edge of the top access door 116 opposite the hinge 115, such as along the top panel 102.

Figure 7A:
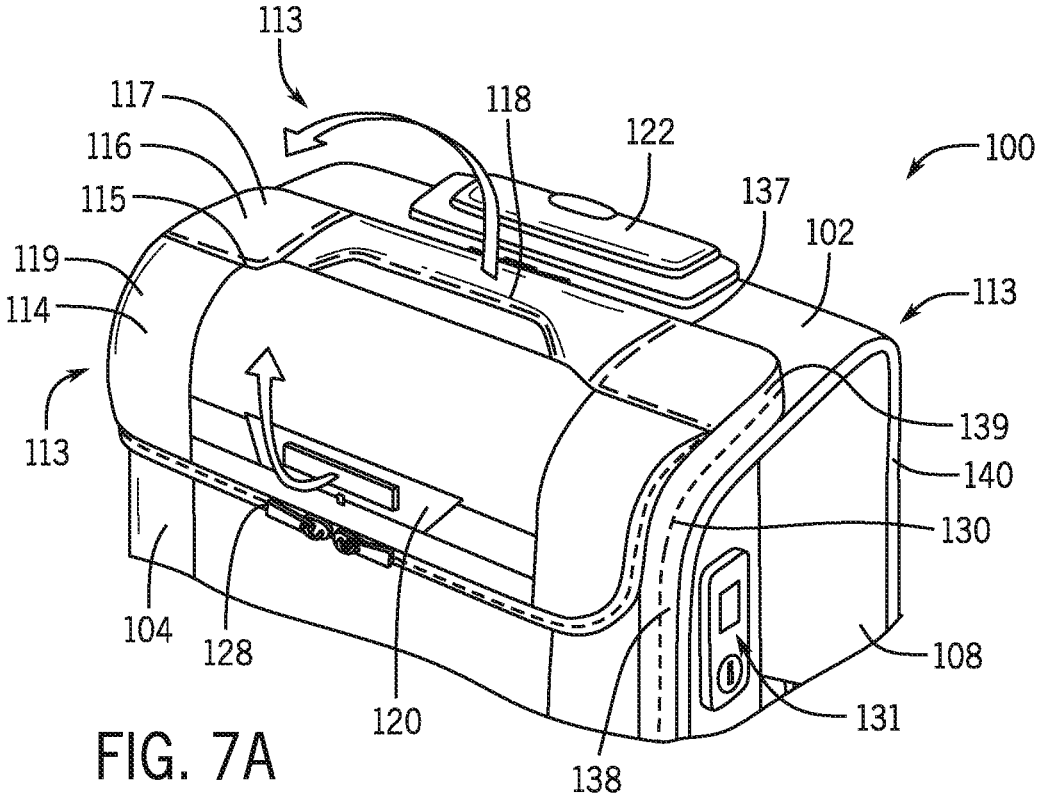
FIG. 7A is an isolated detail view of the easy access system of the luggage article of FIG. 1.
Figure 7B:
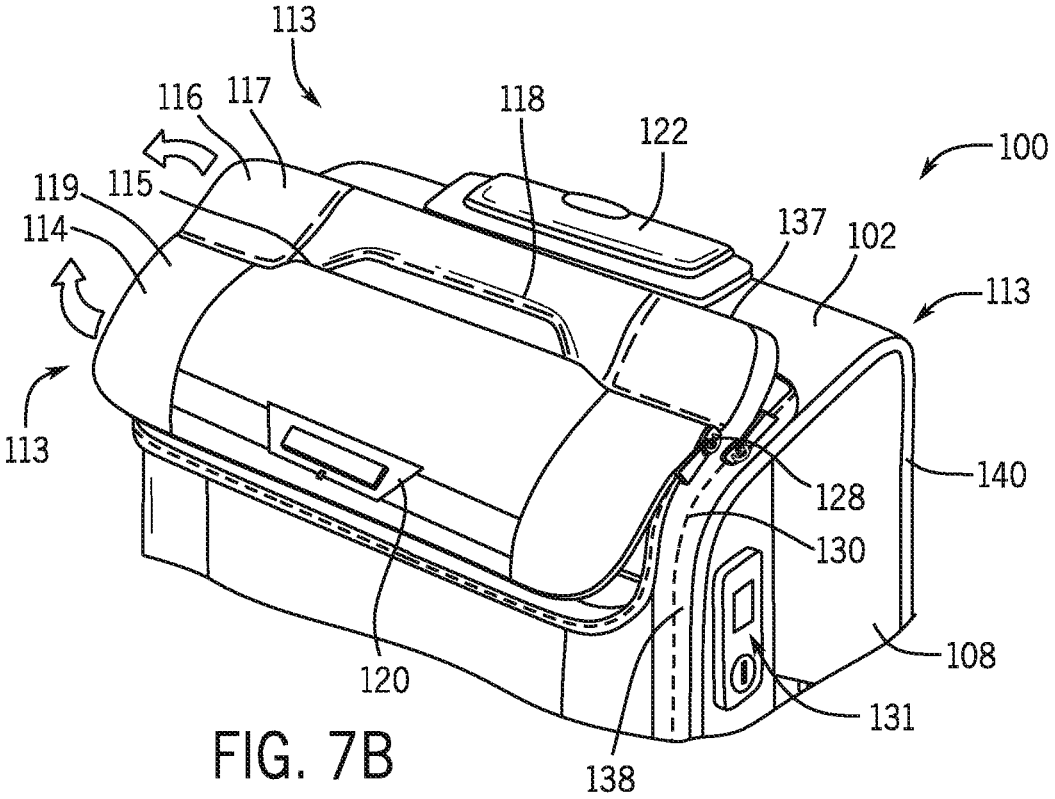
FIG. 7B is an isolated detail view of the easy access system of the luggage article of FIG. 1 with the front and top access doors in an open position.
Figure 7C:
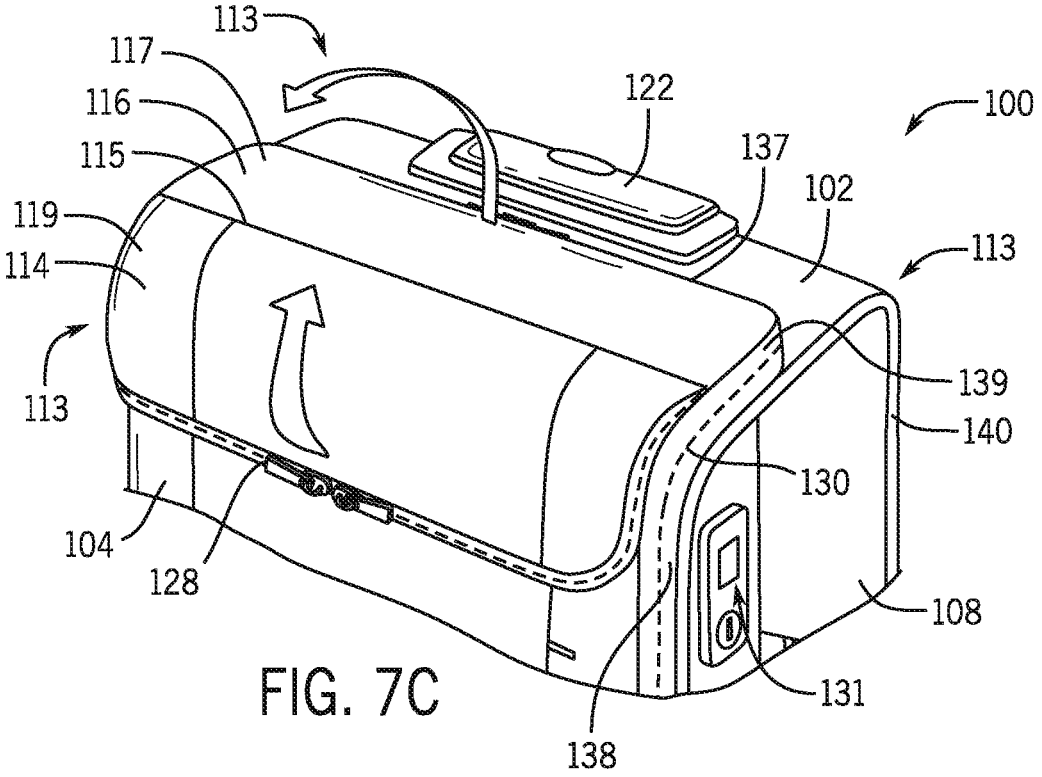
FIG. 7C is an isolated detail view of an alternate embodiment of an easy access system for a luggage article that could be used with the luggage article of FIG. 1.
Figure 7D:
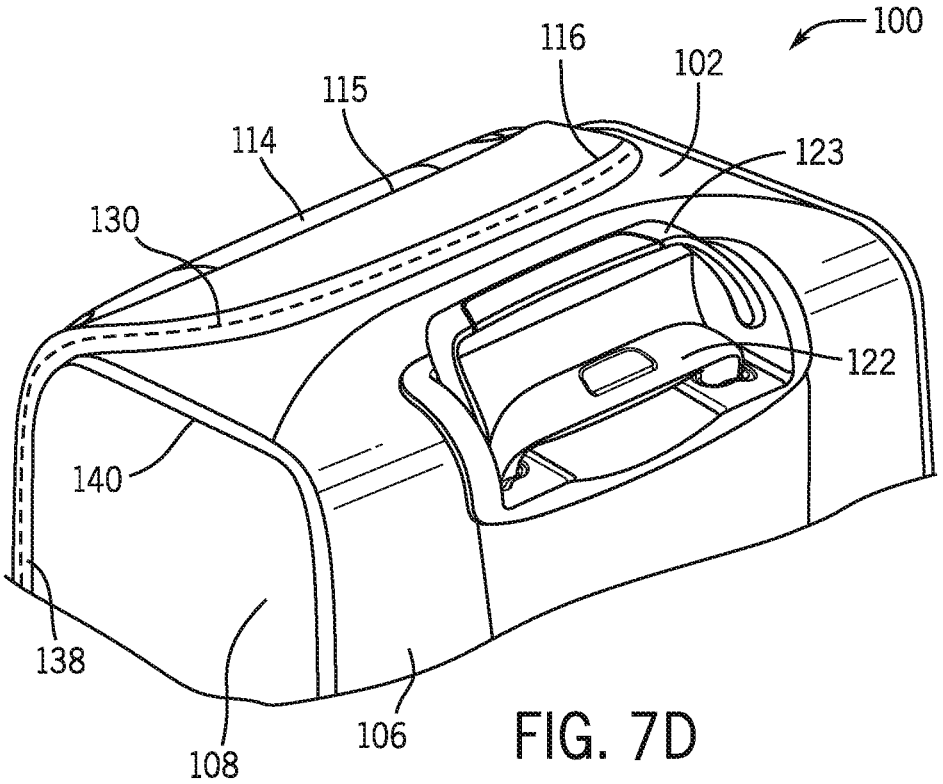
FIG. 7D is an isolated detail view of an integrated carry handle and tow handle that could be used with the luggage article of FIG. 1.

With reference to FIGS. 1-2, 4-5, and 7A-C, the front access door 114 may be a door separate from but defined in an upper portion of the main door 138 and may cover an opening 135 to the main internal storage compartment 148. The front access door 114 may cover an opening 135 defined partially within the front panel 104 and partially within the top panel 102, such that the front access door 114 is positioned proximate a corner region 113 of the luggage case 100. The hinge defining the hinge line 115 provides a hinged connection between the front access door 114 and the main door 138 proximate the top access door 116. The hinge line 115 is positioned on the top panel 102 such that the front access door 114 opens in a direction towards the top panel 102, the back panel 106, and the tow handle 122 and away from the front panel 104 and the bottom panel 112, as shown in FIGS. 4B and 7A-C. In this manner, the front access door 114 opens in a direction opposite the top access door 116 and the main door 138. In this example, the front access door 114 and the top access door 116/main door 138 open towards each other. The front access door 114 may include a front access grip 120 on an outer surface 119. The front access grip 120 may be a piece of material attached at two or three edges to the outer surface 119 with a cavity formed thereunder. In this example, a user may place his or her fingers under the material to grip the front access grip 120 and pull on the front access door 114. However, other configurations are contemplated, such as, for example, a handle protruding from the outer surface 119. As shown in FIG. 7C, in an alternate embodiment, the front access grip 120 may be omitted. In this embodiment, a user may open or close the front access door 114 by engaging and/or disengaging the front access opening mechanism 128.

When in the closed position, the front access door 114 may be secured to and selectively coupled to the main door 138 by a front access opening mechanism 128. The front access opening mechanism 128 may be positioned along one or more peripheral edges of the front access door 114 to engage the front access door 114 and allow selective actuation for opening and closing of the front access door 114. The front access opening mechanism 128 may be a discrete mechanism, such as a latch, or may be a continuous-closure mechanism positioned along at least a portion of the length of a peripheral edge of the front access door 114, such as a zipper. In an open configuration, the front access opening mechanism 128 may be disengaged along a length of the edge of the front access door 114 sufficient to allow the front access door 114 to pivot relative to the main door 138 to any amount from partially open to fully open. In a closed configuration, the front access opening mechanism 128 is engaged along at least a portion of the length of an edge of the front access door 114 to limit relative movement between the front access door 114 and the main door 138.

The front access opening mechanism 128 may be any suitable closure device or system. For instance, the front access opening mechanism 128 may be a zip closure or attachment. In such examples, zipper tape may be connected to the perimeter rim of the front access door 114. In one example, the front access opening mechanism 128 may extend along at least three peripheral edges of the front access door 114, with the hinge 115 being positioned on a remaining edge of the front access door 114. Additionally, the front access opening mechanism 128 may extend along a portion of the length of the edge on the remaining edge of the front access door 114, with the hinge 115 extending along the balance of the length of the edge on the remaining edge. In another example, the front access opening mechanism 128 may be positioned along at least the edge of the front access door 114 opposing the hinge 115, such as along the front panel 104.

Figure 7E:
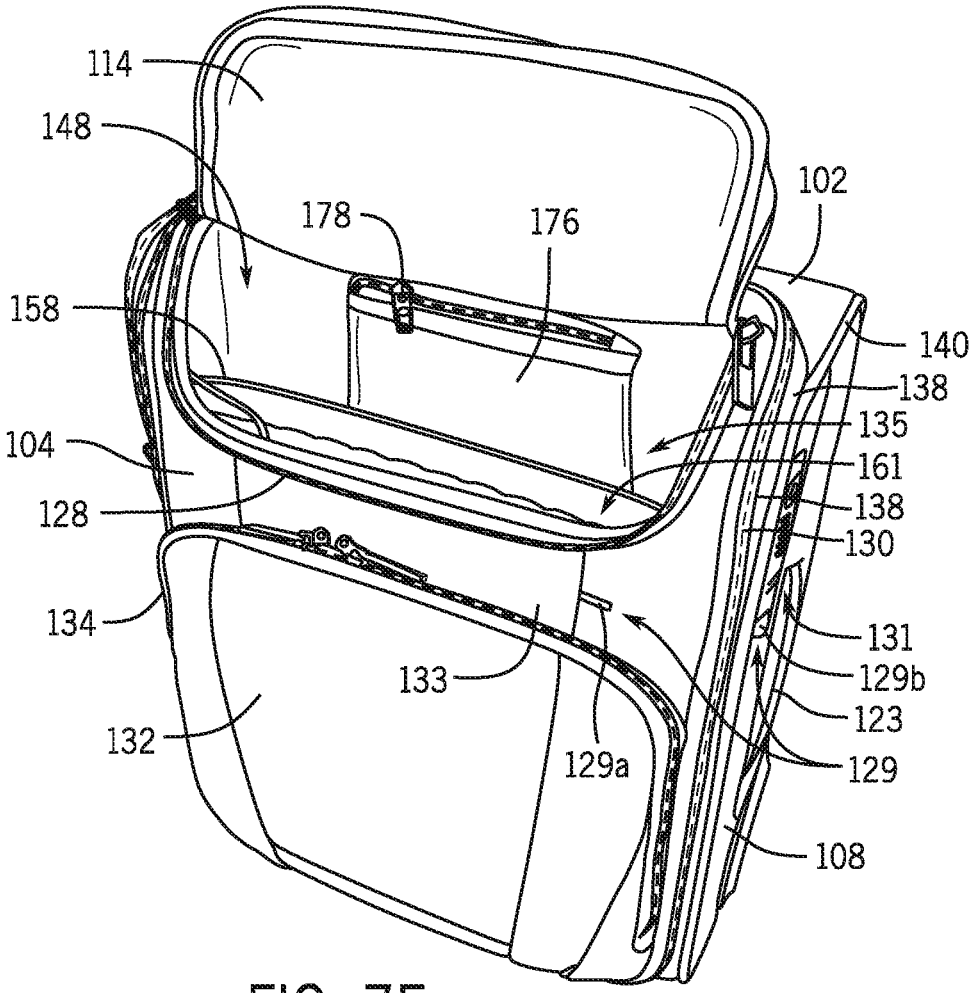
FIG. 7E is a front isometric view of the luggage article of FIG. 1 with the front access door in an open position.

When in the open position, the front access door 114 may provide access to the secondary storage compartment 158, the main compartment 148, or both. FIGS. 7B and 7E show the front access door 114 in an open position, providing access to both the secondary storage compartment 158 and the main compartment 148. In the embodiment shown, the secondary compartment 158, which will be discussed in more detail below, has an opening 161 at the top with a size that is smaller than the size of the opening 135 covered by the front access door 114. In this manner, the front access door 114 provides access to both the secondary compartment 158 and the main compartment 148. In other embodiments, the secondary compartment 158 may have an opening 161 with a size that matches the size of the opening 135 covered by the front access door 114 and that aligns entirely with the opening 135 covered by the front access door 114. In this manner, the front access door 114 may provide access to only the secondary compartment 158. Optionally, the secondary compartment 158 may be removed or omitted, and the front access door 114 may provide access to only the main compartment 148.

The hinge 115 may hingedly connect the front access door 114 to the main door 138 and the top panel 102. The hinge 115 may include any number or combination of a fabric strip, a strip of rubber, a piano hinge, a living hinge, spaced-apart discrete hinges, a zipper structure, an articulating joint made of elastomeric material, or other suitable structures that allow relative movement between the top panel 102 and the main and front access doors 138, 114. Such relative movement may include pure rotation about a fixed pivot axis, or may include rotation about a pivot axis combined with translation or other relative movement. While the depicted embodiment shows a single hinge 115 for the front access door 114, it is also contemplated that there may be more than one hinge. For example, the top and front access doors 116, 114 may each have a separate hinge coupled to the top panel 102.

The manner in which the top access door 116 opens allows a user easy access to the main compartment 148 when, for example, the user is below the luggage case 100. For example, when the luggage case 100 is stowed in an overhead compartment (e.g., onboard an airplane) the luggage case 100 is typically positioned so that the rear panel 106 is facing down and is in contact with the base of the overhead compartment. In this position, a user may open the top access door 116 by opening the main access opening mechanism 130 (e.g., by unzipping) and lifting the top access door 116 via the top access handle 118 (or top access door 116 edges if the handle 118 is omitted) up or away from the rear panel 106. By lifting the top access door 116 upwards, there is nothing in the way between the user and the top access opening in the top panel 102. The user can easily reach into the main compartment 148 and/or the secondary compartment 158 to gain access to any articles stored therein. Further, with the top access door 116 to access the main compartment 148, the user does not need to open the main door 138, which may be difficult due to interference with a top wall of the overhead compartment.

Additionally, the top access door 116 may allow easy access to the main compartment 148 and/or secondary compartment 158 when the luggage article 100 is in an upright position (e.g., with the support members 124, 126 on the ground). For example, to open a main door and access a main compartment with a traditional luggage case, a user must first place the rear panel of the luggage case on the ground. With the luggage case in the horizontal position, the user must bend down to access items in the main compartment. However, with the top access door 116 of the present disclosure, a user does not need to lay the luggage article 100 horizontally and bend down extensively in order to access the main compartment 148. Instead, the user can simply open the top access door 116 and reach down slightly to access the main compartment 148. Further, the user does not need to worry about articles spilling out of the luggage case 100 when accessing the main compartment 148 through the top access door 116 while the luggage article 100 is in the upright position. The gusset 180 of the main access door 138 also prevents articles from falling out of the luggage article 100 when the main access door 138 is opened beyond the top access door 116 by preventing the main access door 138 from opening completely.

The manner in which the front access door 114 opens allows a user easy access to the secondary compartment 158 and/or main compartment 148 when, for example, the luggage case 100 is below the user. For example, when the luggage article 100 is stowed under a seat (e.g., onboard an airplane) the luggage article 100 is typically positioned so that the rear panel 106 is facing down and is in contact with the floor. In this position, a user may open the front access door 114 by opening the front access opening mechanism 127 (e.g., by unzipping) and lifting the front access door 114 via the front access grip 120 (or front access door 114 edges if the front access grip 120 is omitted) towards the tow handle 122. In this manner, the user can fully open the front access door 114 to access the secondary compartment 158 and/or main compartment 148 without any interference from the seat. The front access door 114 may also allow easy access to the main compartment 148 and/or secondary compartment 158 when the luggage article 100 is in an upright position. For example, a user may open the front access door 114 and reach into the secondary compartment 158 and/or main compartment 148 to access articles stored therein without laying the luggage article 100 in a horizontal position on the ground and bending down to reach the articles. The positioning of the front access door 114 allows a user to access articles within the luggage article 100 while the luggage article 100 is in the upright position without having any articles accidentally fall out of the luggage article 100.

Figure 2:
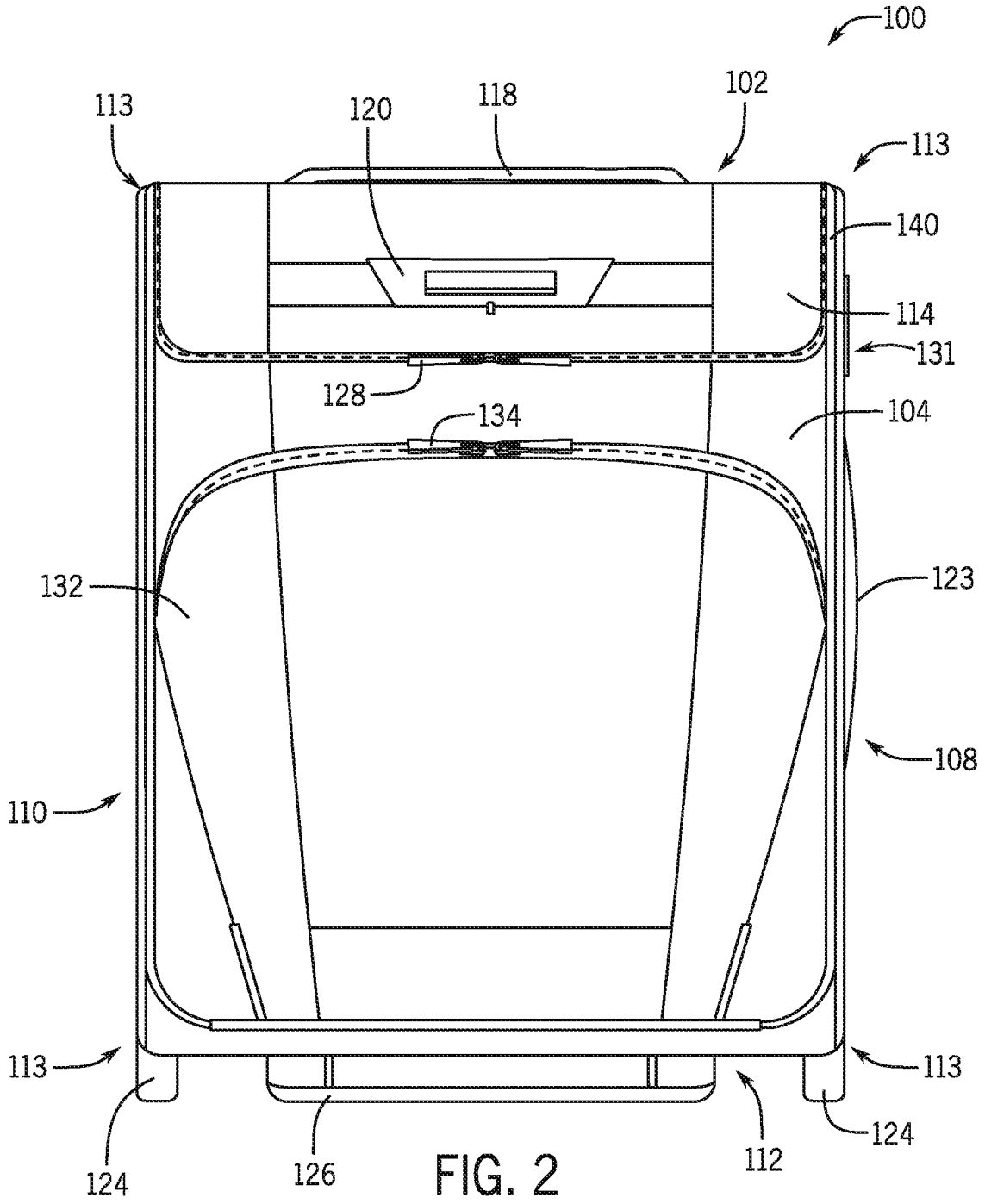
FIG. 2 is a front view of the luggage article of FIG. 1.
Figure 3:
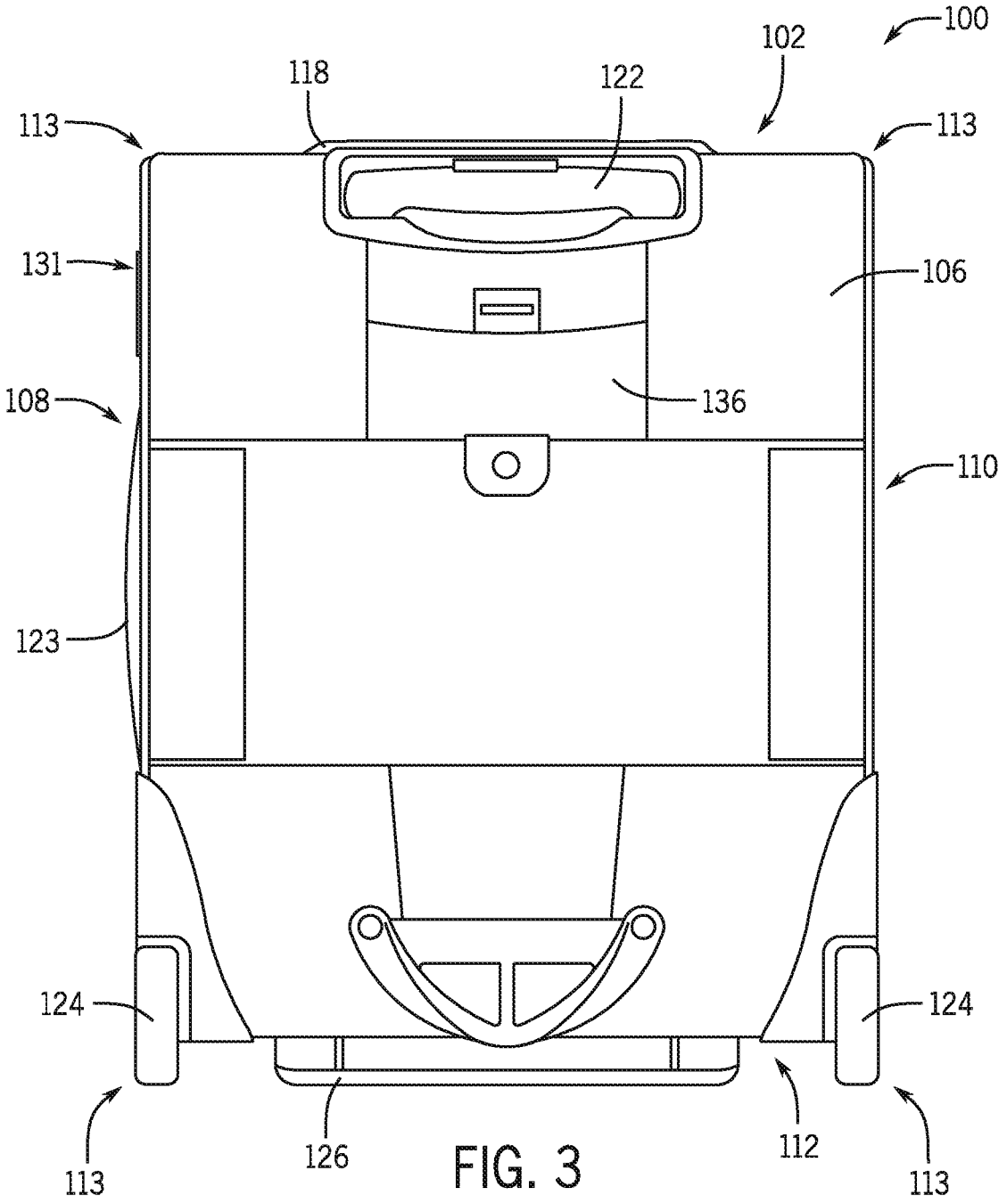
FIG. 3 is a rear view of the luggage article of FIG. 1.
Figure 5:
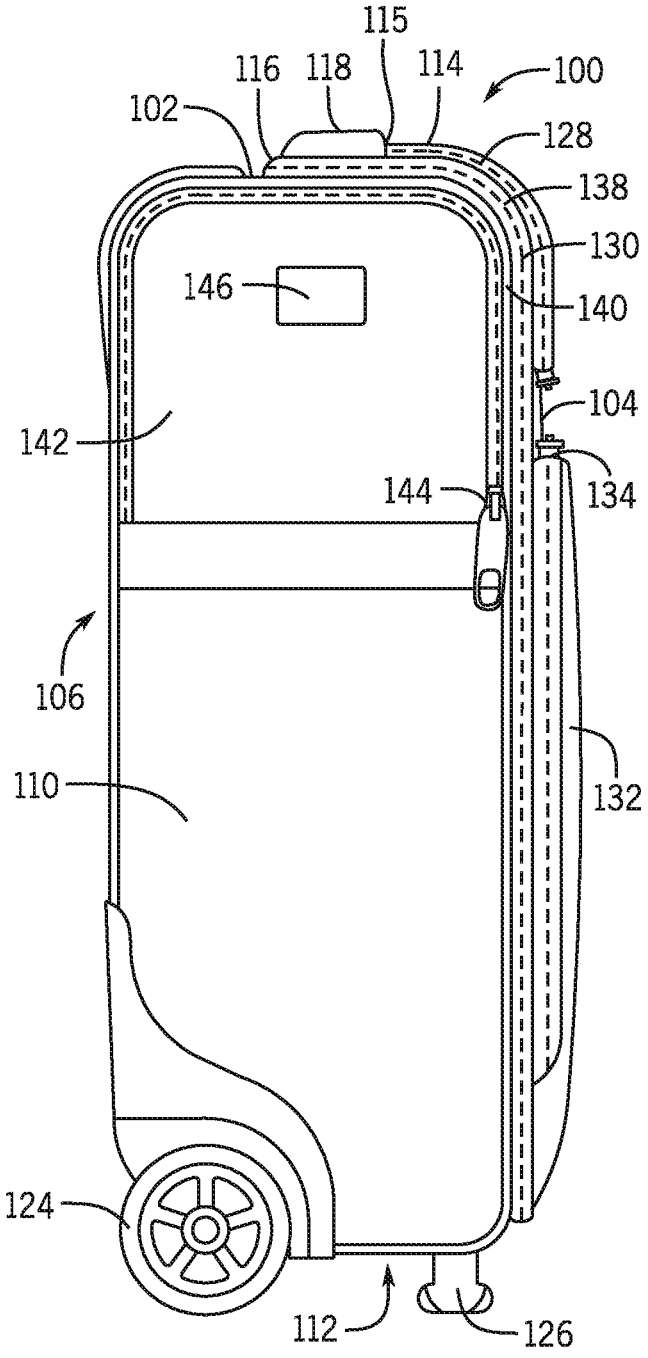
FIG. 5 is a right side view of the luggage article of FIG. 1.
Figure 6:
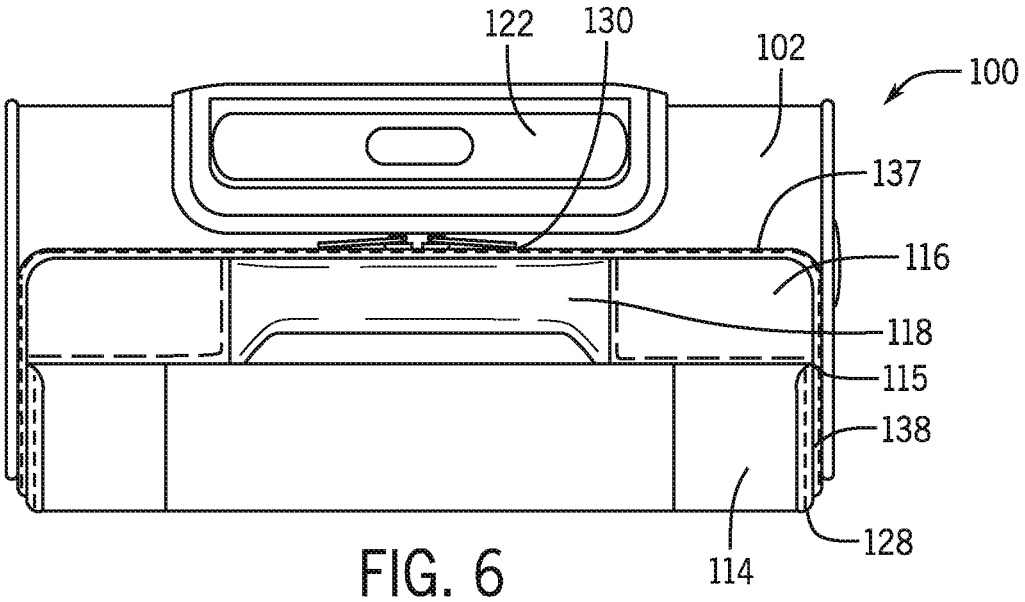
FIG. 6 is a top plan view of the luggage article of FIG. 1.
Figure 11:
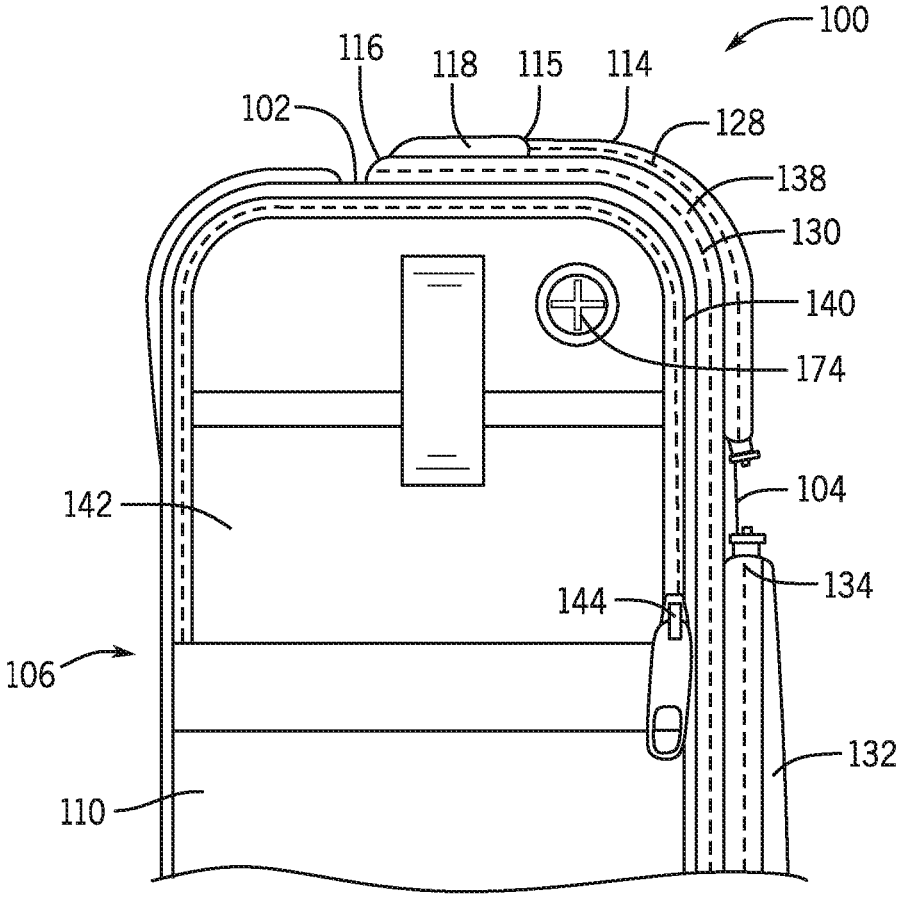
FIG. 11 is a detail view of a side panel of the luggage article of FIG. 1.

The luggage article 100 may also include one or more pockets. For example, as shown in FIGS. 2, 5, 7D, and 11, the luggage article 100 may include a front pocket 132, a side pocket 142, and an internal pocket 176. As shown in FIG. 2, the front pocket 132 may be positioned on a lower portion of the main door 138. The front pocket 132 may be flush with the main door 138 or may be slightly raised from the main door 138. With reference to FIGS. 5 and 11, the side pocket 142 may be positioned on either side panel 108 or 110. For example, as shown, the side pocket 142 may be positioned on an upper portion of the right side panel 110. While only one side pocket 142 is depicted, the luggage article 100 may have two side pockets on either side panel 108, 110. The side pocket 142 may be flush with or slightly raised from the side panel 110. With reference to FIG. 7E, the internal pocket 176 may extend from the top panel 102 into the main compartment 148. As shown, the internal pocket 176 may be suspended within the main compartment 148; however, it is also contemplated that the internal pocket 176 may be coupled to one or more of the back wall 149 and interior side walls 150. While only one internal pocket 176 is shown, it is contemplated that the luggage case 100 may include multiple internal pockets.

The front, side, and internal pockets 132, 142, 176 may provide additional storage space separate from the main compartment 148 and the secondary compartment 158. For example, the pockets 132, 142, 176 may have various dividers, such as pen holders and additional smaller open or closed pockets. As shown, the side pocket 142 may include an aperture 174. The aperture 174 may be sized to fit a cable therethrough. For example, a charger may fit through the aperture 174 to charge a device held within the side pocket 142. As another example, headphones may fit through the aperture 174 for a user to listen to audio played by a device held within the side pocket 142. Alternatively, the side pocket 142 may be omitted and the aperture 174 may be defined directly within a side panel 108 or 110. In this example, the aperture 174 may provide external access to a cable connected to a device stored within the main compartment 148 and/or secondary compartment 158. In the embodiment including the side pocket 142, the side pocket 142 may also include a USB port 146. The USB port 146 may be connected to a power source to allow a user to charge a device through the luggage case 100. The front, side, and internal pockets 132, 142, 176 may each include a closure mechanism 134, 144, 178, respectively. The closure mechanism 134, 144, 178 may be any suitable closure device or system. For instance, the closure mechanism 134, 144, 178 may be a zip closure or attachment. In such examples, zipper tape may be connected to an edge portion of the pocket 132, 144, 176. The pockets 132, 142, 176 may be made of any material, such as for example, a mesh material or a waterproof material to prevent items stored therein from getting wet (e.g., from rain).

Any of the opening and closure mechanisms of the luggage article 100 may be secured by a cable lock system 129, as shown in FIG. 7E. The cable lock system 129 includes a cable 129*a*, which may be stored in a pocket or sleeve 133 and a cable receiving recess 129*b* located on the lock 131 (see FIGS. 7A and 7D). The lock 131 includes a locking feature, such as a dial or latch, and is further configured to receive one or more zipper pulls, such as the zipper pulls associated with at least one of the main access opening mechanism 130, the front access opening mechanism 128, and the closure mechanism 134, and optionally, may also include a cable receiving recess 129*b*. In use, the cable 129*a* is threaded or pulled through one or more hasps or apertures of a zipper pull and secured in a cable receiving recess, thereby securing the zipper pulls and hindering unauthorized entry into one or more compartments of the luggage article 100.

Figure 9:
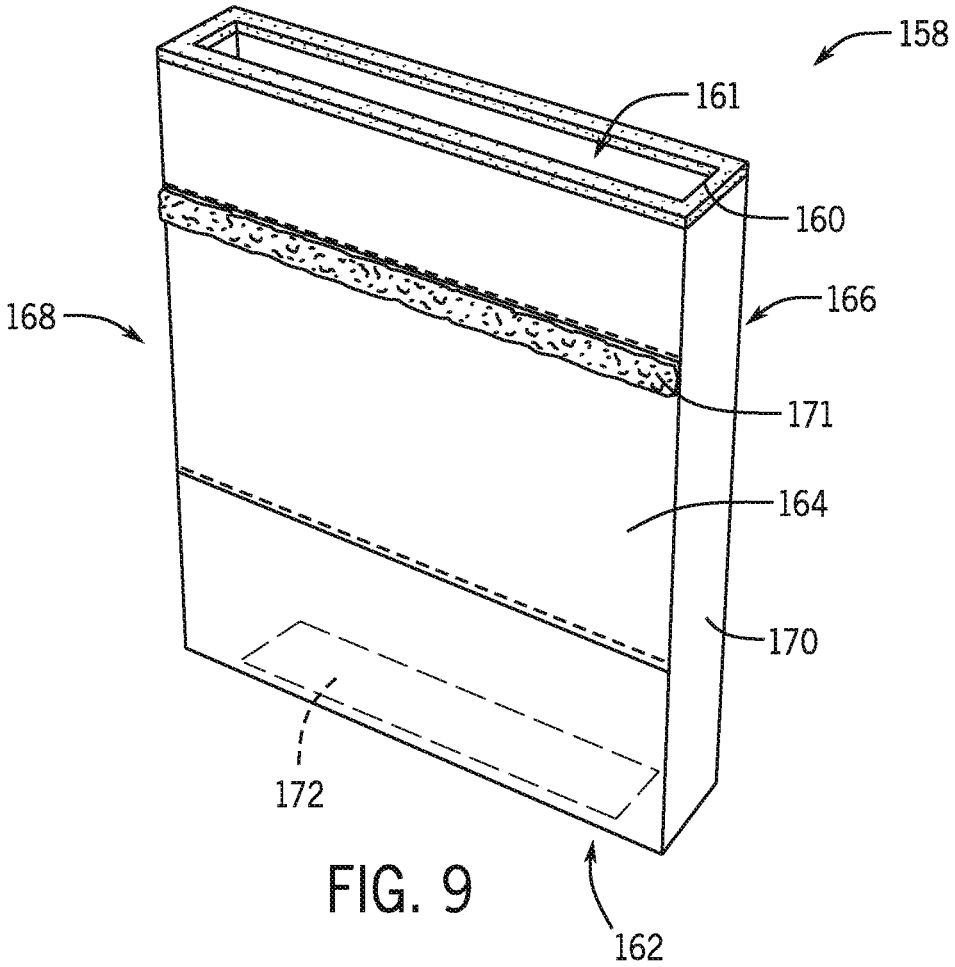
FIG. 9 is a front isometric view of a detachable compartment of the luggage article of FIG. 1.
Figure 10:
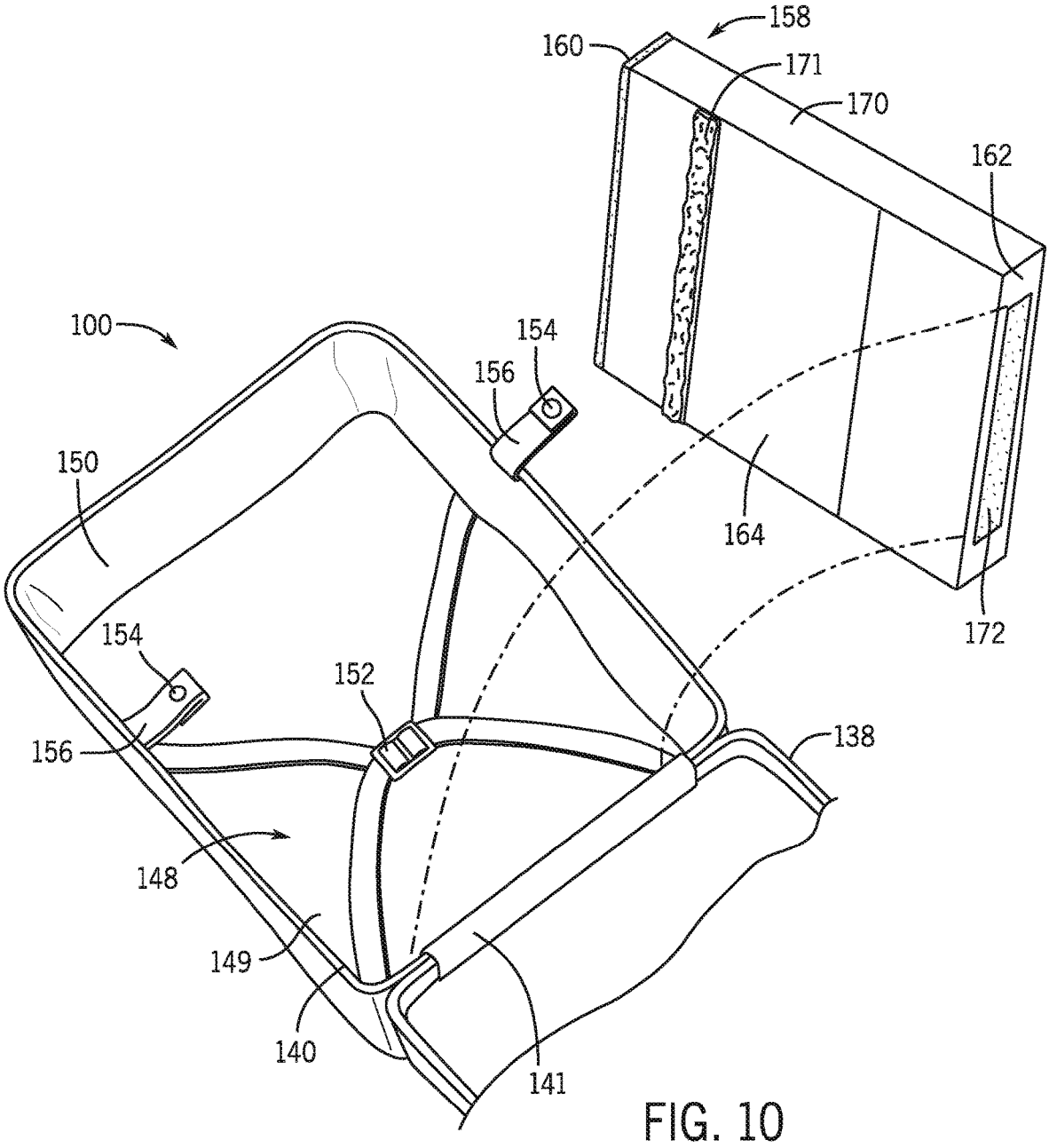
FIG. 10 is an exploded view of the main packing compartment of the luggage article of FIG. 1.

With reference to FIGS. 8-10, the internal compartments of the luggage article 100 will now be discussed in more detail. As shown in FIG. 8, the main compartment 148 may be accessed by fully unzipping the main access opening mechanism 130 and positioning the main door 138 in an open position. The main compartment 148 may form an internal storage volume within the luggage article 100 with a back wall 149 and an interior side wall 150 that extends therefrom around a perimeter of the back wall 149. The distance that the interior side wall 150 extends from the back wall 149 defines the size of the storage volume. The interior side wall 150 may include piping 140 along one or more edges to provide additional support. A fastener extension 156 may extend from the interior side wall 150. As shown, the fastener extension 156 extends from a top edge of the interior side wall 150. The fastener extension 156 may be a relatively flat piece of fabric and may have a generally rectangular shape. The fastener extension 156 may have a fastener 154 at a free end (i.e., the end not attached to the interior side wall 150). The fastener 154 may be a snap fastener, Velcro, or any other type of fastener. The fastener 154 may help to secure a secondary compartment 158, which will be discussed in more detail below. The main compartment 148 may also include a plurality of straps 152 for securing articles within the main compartment 148. In the example shown, two V-shaped straps 152 may be fastened at a center point with a buckle or clip forming an X shape across the main compartment 148 to secure articles once the articles are placed in the main compartment 148. However, other strap 152 configurations are contemplated.

As shown in FIG. 7E, the secondary compartment 158 may be positioned within the main compartment 148 of the luggage article 100. As shown in FIG. 9, the secondary compartment 158 may be formed from a plurality of walls defining an internal storage volume in which to carry a user's belongings. In one example, the secondary compartment 158 may be formed from opposing front and rear walls 164, 166 and a plurality of side walls extending between the front and rear walls 164, 166. For instance, the secondary compartment 158 may include opposing top and bottom walls 160, 162 and opposing right and left side walls 168, 170 extending between the front and rear walls 164, 166. The various walls 160, 162, 164, 166, 168, 170 may be configured or arranged to provide a desired size and shape of the secondary compartment 158. For example, as shown, the secondary compartment 158 may have a generally rectangular shape. The secondary compartment 158 may be a laptop compartment, a laundry bag, a garment bag, a travel organizer, a toiletry bag, or the like. The top wall 160 may define an opening 161 within a portion of or the entirety of the top wall 160. The walls surrounding the opening 161 may include padding, such as, for example, foam, to provide protection for articles stored therein. As shown, the bottom wall 162 may include a fastener 172, such as, for example, a hook and loop fastener, such as a strip of Velcro. The fastener 172 may help to secure the secondary compartment 158 to the main compartment 148, as will be discussed in more detail below. However, it is also contemplated that one or more fasteners may be positioned elsewhere or along other walls in addition to the bottom wall 162. For example, there may be additional fasteners along a lower portion of the front and rear walls 164, 166 or along a lower portion of the right and left side walls 168, 170 to provide additional security to the secondary compartment 158 when it is inserted into the luggage article 100. As shown, the front wall 164 may include a strip of fabric 171 on its surface. The strip of fabric 171 may act as additional cushioning to protect any articles stored in the secondary compartment 158 by spacing the secondary compartment 158 apart from the main compartment 148 and from articles stored therein. For example, the strip of fabric 171 may be any padding material, such as, for example, fleece. While the strip of fabric 171 shown is positioned on an upper portion of the front wall 164, it is contemplated that the strip of fabric 171 may be positioned elsewhere on the front wall 164, on a different wall of the secondary compartment 158, or on multiple walls. Alternatively, the strip of fabric 171 may be a ribbon covering an edge of a pocket coupled to an outer surface of the front wall 164. In this example, the ribbon 171 may prevent fraying of the pocket.

With reference to FIGS. 8-10, the secondary compartment 158 may be removable, such that a user may include or omit the secondary compartment 158 in the luggage article 100, depending upon user preference. The secondary compartment 158 may include fasteners that correspond to fasteners on the main compartment 148. For example, the fastener 172 on the bottom wall 162 of the secondary compartment 158 may correspond to a fastener positioned on the interior side wall 150 of the main compartment 148. In the example where the fastener 172 is a strip of Velcro, the main compartment 148 may include a mating strip of Velcro for securing the secondary compartment 158 to the main compartment 148. In a similar manner, the secondary compartment 158 may include fasteners that correspond to the fasteners 154 on the fastener extensions 156 of the main compartment 148. In the example where the fasteners 154 are snap fasteners, the secondary compartment 158 may include snap fasteners on an upper portion of the secondary compartment 158 that mate with the snap fasteners 154 on the main compartment 148 to secure the secondary compartment 158 to the main compartment 148.

When the secondary compartment 158 is secured within the main compartment 148, it may be positioned on a lower portion of the main compartment 148, as shown. However, it is also contemplated that the secondary compartment 158 may be positioned elsewhere within the main compartment 148, such as, for example, within an upper portion of the main compartment 148. The secondary compartment 158 is positioned within the main compartment 148 such that the opening 161 within the top wall 160 is positioned to correspond with the positioning of the front access door 114. In this manner, the front access door 114 covers the opening 161 within the top wall 160 and provides access to the secondary compartment 158. The secondary compartment 158 may be positioned above the straps 152 within the main compartment 148. For example, the secondary compartment 158 may rest on top of the straps 152. In this manner, a space is defined between the back wall 166 of the secondary compartment 158 and the back wall 149 of the main compartment 148, defining the main internal storage volume. This main internal storage volume is accessible by the top access door 116.

The luggage article 100 is illustrated as a softside luggage case, but may be formed from many combinations of hardside and softside material. For example, the luggage article may be molded from hardside material, or formed from a combination of hardside material and softside material (known as "hybrid" construction). In some examples, the luggage article may be formed entirely from softside material supported by a frame structure suitably configured to allow for the easy access system as described herein. The hardside material may be a thermoplastic material (self-reinforced or fiber-reinforced), ABS, polycarbonate, polypropylene, polystyrene, PVC, polyamide, PTFE, or biaxially oriented polypropylene, among others. The softside material may be nylon, canvas, polyester, leather, PVC, polypropylene, polyethylene, and/or PTFE, among others. In some examples, portions of the luggage article 100 may be extruded from aluminum or other similar metal. In addition, the luggage article may be formed from fiber reinforced epoxy, resin, or other similar material. The luggage article 100 may be formed or molded in any suitable manner, such as by plug molding, blow molding, injection molding, extrusion, casting, press forming, or the like.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage article, comprising:

a first panel adjacent to a second panel;

a first door defined by at least a portion of the first panel and at least a portion of the second panel, wherein the first door is selectively coupled to at least another portion of the second panel;

a second door defined in the first door;

a tow handle; and at least two wheels coupled to a bottom panel of the luggage article, wherein the first door and the second door share a common hinge;

wherein the first door opens in a direction opposite to the second door about the common hinge, and wherein the first door and the second door provide access to a main compartment.

2. The luggage article of claim 1, wherein the first panel is a front panel.

3. The luggage article of claim 1, wherein the second panel is a top panel.

4. The luggage article of claim 1, wherein the second door is defined within at least a portion of the first panel and at least a portion of the second panel.

5. The luggage article of claim 1, wherein the first door opens in a direction away from the second panel.

6. The luggage article of claim 1, wherein the second door opens in a direction towards the second panel.

7. The luggage article of claim 1, wherein the portion of the first door defined within the second panel is movable relative to a remaining portion of the first door defined within the first panel.

8. The luggage article of claim 1, further comprising a secondary compartment, wherein the secondary compartment is detachable from the luggage article.

9. The luggage article of claim 8, wherein the secondary compartment is connected to the luggage article by at least one of snap buttons and a hook and loop fastener.

10. The luggage article of claim 8, wherein the second door provides access to the secondary compartment.

11. The luggage article of claim 1, wherein the first and second doors are opened by one or more zippers.

12. The luggage article of claim 1, wherein the second door is defined by a portion of the first door.

13. The luggage article of claim 1, wherein the first door opens to provide an opening opposite from the tow handle and the second door opens towards the tow handle.

* * * * *